US009840023B2

(12) United States Patent
Nakamura

(10) Patent No.: US 9,840,023 B2
(45) Date of Patent: Dec. 12, 2017

(54) SHEET MANUFACTURING APPARATUS AND SHEET MANUFACTURING METHOD

(71) Applicant: SEIKO EPSON CORPORATION, Tokyo (JP)

(72) Inventor: Masahide Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 14/988,951

(22) Filed: Jan. 6, 2016

(65) Prior Publication Data

US 2016/0221213 A1 Aug. 4, 2016

(30) Foreign Application Priority Data

Feb. 2, 2015 (JP) ..... 2015-018189

(51) Int. Cl.

| | |
|---|---|
| ***D04H 1/732*** | (2012.01) |
| ***D04H 1/60*** | (2006.01) |
| ***D04H 1/413*** | (2012.01) |
| ***D21F 9/00*** | (2006.01) |
| ***B27N 3/02*** | (2006.01) |
| ***B27N 3/04*** | (2006.01) |
| ***B27N 3/14*** | (2006.01) |
| ***D04H 1/425*** | (2012.01) |
| *B27N 1/02* | (2006.01) |

(52) U.S. Cl.

CPC ..... *B27N 3/02* (2013.01); *B27N 3/04* (2013.01); *B27N 3/14* (2013.01); *D04H 1/425* (2013.01); *D04H 1/732* (2013.01); *D21F 9/00* (2013.01); *B27N 1/02* (2013.01)

(58) Field of Classification Search

None

See application file for complete search history.

(56) References Cited

U.S. PATENT DOCUMENTS 4,640,810 A * 2/1987 Laursen ..... D04H 1/732 264/121
6,709,613 B2 * 3/2004 Chambers, Jr. ... A61F 13/15658 264/121

(Continued)

FOREIGN PATENT DOCUMENTS

| | | |
|---|---|---|
| JP | 2012-144819 A | 8/2012 |
| JP | 2015-066932 A | 4/2015 |
| JP | 2015-066933 A | 4/2015 |

*Primary Examiner* — Mary F Theisen

(74) *Attorney, Agent, or Firm* — Global IP Counselors, LLP

(57) ABSTRACT

A sheet manufacturing apparatus of the present invention includes a defibrating unit that defibrates a material containing fibers into a defibrated material, and a deposition unit that deposits a defibrated material defibrated by the defibrating unit. The deposition unit includes a material supply port through which the defibrated material from the defibrating unit is supplied, a plurality of opening ports through which the supplied defibrated material passes, and a dwell area disposed between the material supply port and the opening ports so that the defibrated material temporarily dwells in the dwell area. The dwell area allows the defibrated material to temporarily dwell in the dwell area so that a variation amount of the defibrated material that passes through the opening ports becomes smaller than a variation amount of the defibrated material supplied through the material supply port.

5 Claims, 4 Drawing Sheets

(56) References Cited

U.S. PATENT DOCUMENTS

| | | | |
|---|---|---|---|
| 8,882,965 | B2 | 11/2014 | Yamagami et al. |
| 9,174,243 | B2 | 11/2015 | Nakamura |
| 9,194,081 | B2 | 11/2015 | Yamagami |

* cited by examiner

SHEET MANUFACTURING APPARATUS AND SHEET MANUFACTURING METHOD

BACKGROUND

1. Technical Field

The present invention relates to a sheet manufacturing apparatus and a sheet manufacturing method.

2. Related Art

Sheet manufacturing apparatuses conventionally use a so-called wet method in which a raw material containing fibers is introduced into water and is repulped mainly by mechanical process. Such sheet manufacturing apparatuses need a large amount of water and energy for drying thereby leading to increase in the size of apparatus. JPA-2012-144819 proposes a sheet manufacturing apparatus which uses a dry method in order to reduce the size and energy.

However, this paper recycling apparatus has a problem that the grammage of produced sheet varies depending on the amount of raw material supplied at the upstream end.

SUMMARY

An advantage of some aspects of the invention is that a sheet manufacturing apparatus and a sheet manufacturing method which reduce variation in the grammage of sheet regardless of variation in the amount of raw material supplied at the upstream end are provided.

The present invention has been made to overcome at least part of the problem described above, and can be implemented in the following embodiments or application examples.

According to an aspect of the present invention, a sheet manufacturing apparatus includes a defibrating unit configured to defibrate a material containing fibers into a defibrated material, and a deposition unit configured to deposit a defibrated material defibrated by the defibrating unit, the deposition unit including a supply port through which the defibrated material from the defibrating unit is supplied, a plurality of opening ports through which the supplied defibrated material passes, and a dwell area disposed between the supply port and the opening ports so that the defibrated material temporarily dwells in the dwell area, wherein the dwell area allows the defibrated material to temporarily dwell in the dwell area so that a variation amount of the defibrated material that passes through the opening ports becomes smaller than a variation amount of the defibrated material supplied through the material supply port.

According to the above sheet manufacturing apparatus, since the defibrated material is allowed to temporarily dwell in the dwell area, variation in the supply amount of defibrated material can be absorbed, thereby reducing variation in the grammage of sheet to be manufactured.

In the sheet manufacturing apparatus according to the above aspect of the present invention, the dwell area may allow the defibrated material of an amount of 30% or more and 80% or less of a volume of the dwell area to dwell in the dwell area when an amount of the defibrated material supplied from the supply port per unit time is constant.

Accordingly the above sheet manufacturing apparatus, since the amount of deposition is set to be 30% or more and 80% or less of the dwell area, variation in the grammage of sheet to be manufactured can be reduced.

The sheet manufacturing apparatus according to the above aspect of the present invention, may further include a supplying unit configured to supply a material to be defibrated. The dwell area may allow the defibrated material having a mass of 10 times or more of that of the material supplied from the supplying unit per unit time when the amount of the defibrated material supplied from the supply port per unit time is constant.

Accordingly the above sheet manufacturing apparatus, since the dwell area allows the defibrated material having the mass of 10 times or more of that of the raw material to dwell in the dwell area, variation in the supply amount of raw material due to double feeding (multifeed) or feeding failure of a sheet can be absorbed, thereby reducing variation in the grammage of sheet to be manufactured.

In the sheet manufacturing apparatus according to the above aspect of the present invention, it is possible that the supply port is a second supply port, the opening port is a second opening port, the dwell area is a second dwell area, a first dwell area is further provided between the defibrating unit and the deposition unit so that the defibrated material temporarily dwells in the first dwell area, and the first dwell area is provided between a first supply port through which the defibrated material from the defibrating unit is supplied and a plurality of first opening ports through which the supplied defibrated material passes, and the first dwell area allows the defibrated material to temporarily dwells in the first dwell area so that a variation amount of the defibrated material that passes through the first opening ports becomes smaller than a variation amount of the defibrated material supplied through the first supply port.

According to the above sheet manufacturing apparatus, since two dwell areas are provided, variation in the supply amount can be absorbed in two steps, thereby reducing variation in the grammage of sheet to be manufactured compared with the case of one dwell area.

According to another aspect of the present invention, a sheet manufacturing method includes defibrating a material containing fibers into a defibrated material, and allowing the defibrated material to deposit through a plurality of opening ports to form a sheet, wherein the defibrated material temporarily dwells so that a variation amount of the defibrated material that passes through the opening ports becomes smaller than a variation amount of the supplied defibrated material.

According to the above sheet manufacturing method, since the defibrated material is allowed to temporarily dwell, variation in the supply amount of defibrated material can be absorbed, thereby reducing variation in the grammage of sheet to be manufactured.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, a preferred embodiment of the present invention will be described in detail. The embodiment described below is not intended to unreasonably limit the scope of the present invention defined in the appended claims. Further, all the configuration described below are not necessarily indispensable elements of the present invention.

A sheet manufacturing apparatus according to the present embodiment includes a defibrating unit that defibrates a material containing fibers into a defibrated material, and a deposition unit that deposits a defibrated material defibrated by the defibrating unit, the deposition unit including a supply port through which the defibrated material from the defibrating unit is supplied, a plurality of opening ports through which the supplied defibrated material passes, and a dwell area disposed between the supply port and the opening ports so that the defibrated material temporarily dwells in the dwell area, wherein the dwell area allows the defibrated material to temporarily dwell in the dwell area so that a variation amount of the defibrated material that passes through the opening ports becomes smaller than a variation amount of the defibrated material supplied through the material supply port.

1. Sheet Manufacturing Apparatus 1.1. Configuration

Figure 1:
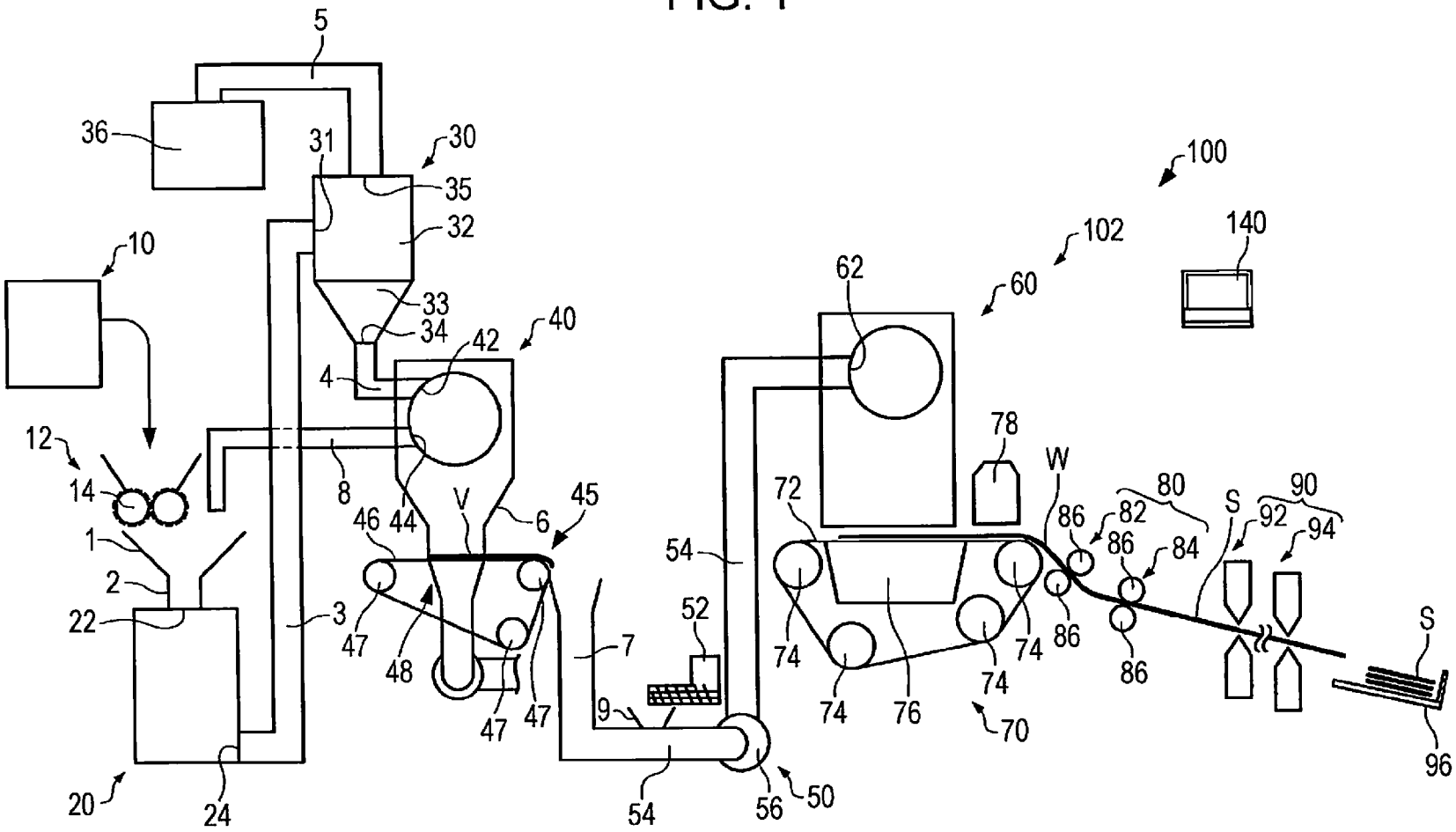
FIG. 1 is a schematic view of a sheet manufacturing apparatus according to the present embodiment.

First, with reference to the drawings, a sheet manufacturing apparatus according to the present embodiment will be described. FIG. 1 is a schematic view of a sheet manufacturing apparatus 100 according to the present embodiment.

As shown in FIG. 1, the sheet manufacturing apparatus 100 includes a supplying unit 10, a manufacturing unit 102, and a control unit 140. The manufacturing unit 102 manufactures a sheet. The manufacturing unit 102 includes a crushing unit 12, a defibrating unit 20, a classifying unit 30, a screening unit 40, a first web-forming unit 45, a mixing unit 50, a deposition unit 60, a second web-forming unit 70, a sheet-forming unit 80 and a cutting unit 90.

The supplying unit 10 supplies raw material to the crushing unit 12. The supplying unit 10 is, for example, an automatic loading unit that is configured to continuously load the raw material into the crushing unit 12. The raw material to be supplied by the supplying unit 10 is, for example, recycled paper or pulp sheet that contains fibers.

As the raw material is supplied by the supplying unit 10, the crushing unit 12 cuts the raw material in air into small pieces. The small pieces are shaped and sized into, for example, a few centimeters square. In the illustrated example, the crushing unit 12 includes a crushing blade 14 so that the crushing blade 14 can cut the loaded raw material. For example, the crushing unit 12 may be a shredder. The raw material cut by the crushing unit 12 is received by a hopper 1 and is conveyed (transferred) to the defibrating unit 20 via a pipe 2.

The defibrating unit 20 defibrates the raw material cut by the crushing unit 12. The term "defibrate" as used herein means to untangle the raw material (defibration object) made up of a plurality of bonded fibers into individual fibers. The defibrating unit 20 also has a function of allowing materials such as resin particle, ink, toner and blur-preventing agent attached to the raw material to be separated from the fiber.

The raw material which has passed through the defibrating unit 20 is called "defibrated material." The "defibrated material" may contain, in addition to the disentangled fibers of defibrated material, particles of resin (resin for bonding a plurality of fibers to each other), color agents such as ink and toner, and additive agents such as blur-preventing agent and strengthening agent which are separated from the fiber during untangling of fibers. The disentangled defibrated material is string-like or ribbon-like shape. The disentangled defibrated material may exist in the state of not being tangled with other untangled fiber (independent state), or alternatively, in the state of being tangled together with other disentangled defibrated material (the state of forming so-called "lumps").

The defibrating unit 20 performs dry defibration in atmosphere (in air). For example, an impeller mill can be used as the defibrating unit 20. The defibrating unit 20 has a function of generating an airflow so as to suction raw material and discharge defibrated material. Accordingly, the defibrating unit 20 can suction the raw material along with the airflow generated by the defibrating unit 20 through the inlet port 22, perform a defibration process, and transfer the defibrated material to the outlet port 24. The defibrated material which has passed through the defibrating unit 20 is conveyed to the classifying unit 30 via a pipe 3.

The classifying unit 30 classifies the defibrated material which has passed through the defibrating unit 20. Specifically, the classifying unit 30 isolates and removes the defibrated material having relatively small size or low density (such as resin particles, color agents and additive agents). As a result, the percentage of fibers having relatively large size or high density to the defibrated material can be increased.

The classifying unit 30 may be an airflow classifier. The airflow classifier generates a swirling airflow so as to separate the material depending on the centrifugal force applied to the material which are different depending on the size and density of the material to be classified. A classifying point can be adjusted by adjusting the rate of airflow and the magnitude of centrifugal force. Specifically, the classifying unit 30 may be cyclone classifier, elbow-jet classifier, Eddy classifier or the like. Particularly, since a cyclone classifier as shown in the figure has a simple configuration, it can be preferably used as the classifying unit 30.

The classifying unit 30 includes, for example, an inlet port 31, a cylindrical section 32 which is connected to the inlet port 31, an inverted conical section 33 which is continuous from the cylindrical section 32 and is disposed under the cylindrical section 32, a lower outlet port 34 provided at the center of a lower part of the inverted conical section 33, and an upper outlet port 35 provided at the center of an upper part of the cylindrical section 32.

In the classifying unit 30, an airflow which involves the defibrated material introduced from the inlet port 31 moves in a circulating motion in the cylindrical section 32. As a result, a centrifugal force is applied to the introduced defibrated material, and the classifying unit 30 can separate the defibrated material into fibers (first classified material) having a larger size and a higher density than those of resin particles and ink particles, and resin particles, color agents and additive agents (second classified material) having a smaller size and a lower density than those of fibers. The first classified material (fraction) is discharged from the lower outlet port 34 and introduced into the screening unit 40 via a pipe 4. On the other hand, the second classified material (fraction) is discharged from the upper outlet port 35 into a receiving unit 36 via a pipe 5.

The screening unit 40 allows the first classified material (defibrated material defibrated by the defibrating unit 20) which has passed through the classifying unit 30 to be introduced through the inlet port 42 so as to screen the defibrated material depending on the length of fibers. For example, a sieve can be used as the screening unit 40. The screening unit 40 may include a mesh (filter, screen) so as to separate the material contained in the first classified material into the fibers or particles having a size smaller than the size of mesh opening (first screened material, which pass through the mesh), and the fibers, undefibrated piece or lumps having a size larger than the size of mesh opening (second screened material, which does not pass through the mesh). For example, the first screened material is received by the hopper 6 and then conveyed to the mixing unit 50 via a pipe 7. The second screened material is returned to the defibrating unit 20 from the outlet port 44 via a pipe 8. Specifically, the screening unit 40 is a cylindrical sieve that can rotate by means of a motor. The mesh of the screening unit 40 may be, for example, a wire mesh, an expand metal formed by expanding a metal sheet having notches or a punching metal formed by punching a metal sheet by using a press machine or the like.

The first web-forming unit 45 allows the first screened material which has passed through the screening unit 40 to be transferred to the mixing unit 50. The first web-forming unit 45 includes a mesh belt 46, stretching rollers 47 and a suctioning unit (suction mechanism) 48.

As the first screened material passes through the opening port (mesh openings) of the screening unit 40 and is dispersed in air, the suctioning unit 48 can suction the first screened material onto the mesh belt 46. The first screened material is deposited on the moving mesh belt 46 to form a web V. Basic configurations of the mesh belt 46, the stretching rollers 47 and suctioning unit 48 are similar to those of a mesh belt 72, stretching rollers 74 and a suction mechanism 76 of the second web-forming unit 70, which will be described later.

The web V is formed softly bulky containing abundant air while it is fed through the screening unit 40 and the first web-forming unit 45. The web V deposited on the mesh belt 46 is introduced into the pipe 7 and is transferred to the mixing unit 50.

The mixing unit 50 mixes the first screened material which has passed through the screening unit 40 (the first screened material transferred by the first web-forming unit 45) and an additive agent which contains resin. The mixing unit 50 includes an additive agent supply unit 52 that supplies an additive agent, a pipe 54 that transfers the screened material and the additive agent, and a blower 56. In the illustrated example, the additive agent is supplied from the additive agent supply unit 52 to the pipe 54 via the hopper 9. The pipe 54 is connected to the pipe 7.

The mixing unit 50 generates an airflow by the blower 56 so as to mix and transfer the first screened material and the additive agent in the pipe 54. The mechanism for mixing the first screened material and the additive agent is not specifically limited, and may have a blade that rotates in high speed for stirring, or alternatively, may be a V-type mixer that uses rotation of the container.

The additive agent supply unit 52 may be a screw feeder as shown in FIG. 1 or a disk feeder, which is not shown in the figure. The additive agent supplied by the additive agent supply unit 52 includes resin for bonding a plurality of fibers. At the time when the resin is supplied, a plurality of fibers are not bonded. The resin melts while it passes through the sheet-forming unit 80 and bonds a plurality of fibers to each other.

The resin supplied by the additive agent supply unit 52 is thermoplastic resin or heat-curable resin, and may be, for example, AS resin, ABS resin, polypropylene, polyethylene, polyvinyl chloride, polystyrene, acryl resin, polyester resin, polyethylene terephthalate, polyphenylene ether, polybutylene terephthalate, nylon, polyamide, polycarbonate, polyacetal, polyphenylene sulfide, or polyether ether ketone. Those resins may be used alone or in combination thereof as appropriate. The additive agent supplied by the additive agent supply unit 52 may be in the form of fiber or powder.

Further, the additive agent supplied by the additive agent supply unit 52 may include, in addition to the resin that bonds fibers to each other, coloring agent for coloring fibers, anti-aggregation agent for preventing aggregation of fibers, or flame retardant agent for retarding flaming of fibers depending on the type of sheet to be manufactured. The mixture (mixture of the first classified material and the additive agent) which has passed through the mixing unit 50 is conveyed to the deposition unit 60 via the pipe 54.

The deposition unit 60 allows the mixture which has passed through the mixing unit 50 to be introduced through an inlet port 62, and allows the entangled defibrated material (fibers) to be disentangled so that they are dispersed in air and deposited in the deposition unit 60. Further, when the resin of the additive agent supplied by the additive agent supply unit 52 is in the form of fiber, the deposition unit 60 allows the entangled resin to be disentangled. Accordingly, the deposition unit 60 allows the mixture to be uniformly deposited in the second web-forming unit 70.

The deposition unit 60 may be a cylindrical sieve that rotates. The deposition unit 60 includes a mesh and allows fibers or particles contained in the mixture which has passed through the mixing unit 50 and having a size smaller than the size of mesh opening (fibers or particles which pass through the mesh) to be precipitated. The deposition unit 60 has the same configuration as that of, for example, the screening unit 40.

The "sieve" of the deposition unit 60 may not have a function of screening a specific target. That is, the "sieve" used as the deposition unit 60 may be any device having a mesh, and the deposition unit 60 may precipitate all of the mixture introduced into the deposition unit 60.

The second web-forming unit 70 allows the passed material which has passed through the deposition unit 60 to be deposited thereon so as to form a web W. The second web-forming unit 70 includes, for example, the mesh belt 72, the stretching rollers 74 and the suction mechanism 76.

While the mesh belt 72 moves, it allows the passed material which has passed through the opening port of the deposition unit 60 (mesh openings) to be deposited thereon. The mesh belt 72, which is hung on the stretching rollers 74, is formed not to easily permit the passing of the passed material but permit the passing of air. The mesh belt 72 moves by rotation of the stretching rollers 74. While the mesh belt 72 continuously moves, the passed material which has passed through the deposition unit 60 is continuously deposited on the mesh belt 72 to form the web W on the mesh belt 72. The mesh belt 72 is made of, for example, metal, resin, cloth or non-woven fabric.

The suction mechanism 76 is disposed under the mesh belt 72 (opposite to the deposition unit 60). The suction mechanism 76 can generate a downward airflow (airflow directed from the deposition unit 60 to the mesh belt 72). The suction mechanism 76 allows the mixture which has been dispersed in air by the deposition unit 60 to be suctioned onto the mesh belt 72. As a result, a discharge rate from the deposition unit 60 can be increased. Further, the suction mechanism 76 can generate a downflow in a falling path of the mixture, thereby preventing the defibrated material and additive agent from being entangled.

As described above, as the material passes through the deposition unit 60 and the second web-forming unit 70 (web-forming process), the web W is formed softly bulky containing abundant air. The web W deposited on the mesh belt 72 is transferred to the sheet-forming unit 80.

In the illustrated example, a moisture-adjusting unit 78 that adjusts moisture of the web W is provided. The moisture-adjusting unit 78 can adjust the ratio of the amount of the web W and water by adding water or water vapor to the web W.

The sheet-forming unit 80 forms a sheet S by applying heat and pressure on the web W deposited on the mesh belt 72. The sheet-forming unit 80 can bond a plurality of fibers in the mixture to each other via the additive agent (resin) by applying heat on the mixture of the defibrated material and additive agent mixed in the web W.

The sheet-forming unit 80 may be, for example, heater roller, hot press forming machine, hot plate, heated air blower, infrared heater or flash fixing device. In the illustrated example, the sheet-forming unit 80 includes a first bonding unit 82 and a second bonding unit 84, and the bonding units 82 and 84 each includes a pair of heating rollers 86. Since the bonding units 82 and 84 are provided as the heating rollers 86, the sheet S can be formed while the web W is continuously transferred unlike the case where the bonding units 82 and 84 are provided as a plate-shaped press machine (plate press machine). The number of the heating rollers 86 is not specifically limited.

The cutting unit 90 cuts the sheet S which has been formed by the sheet-forming unit 80. In the illustrated example, the cutting unit 90 includes a first cutting unit 92 that cuts the sheet S in a direction crossing a transfer direction of the sheet S and a second cutting unit 94 that cuts the sheet S in a direction parallel to the transfer direction. For example, the second cutting unit 94 cuts the sheet S which has passed the first cutting unit 92.

As described above, the sheet S in the form of a cut sheet having a predetermined size is formed. The sheet S in the form of a cut sheet is discharged into the discharge unit 96.

1.2. Dwell Area

Figure 2:
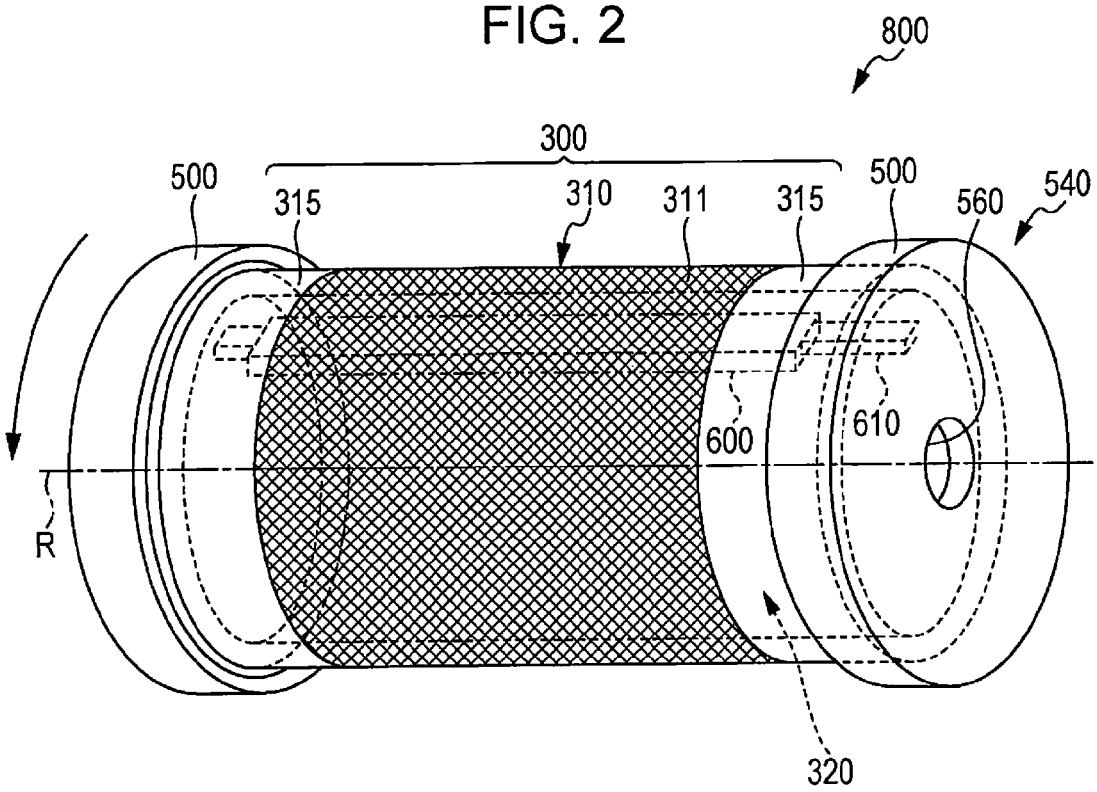
FIG. 2 is a schematic view of a sieve.
Figure 3:
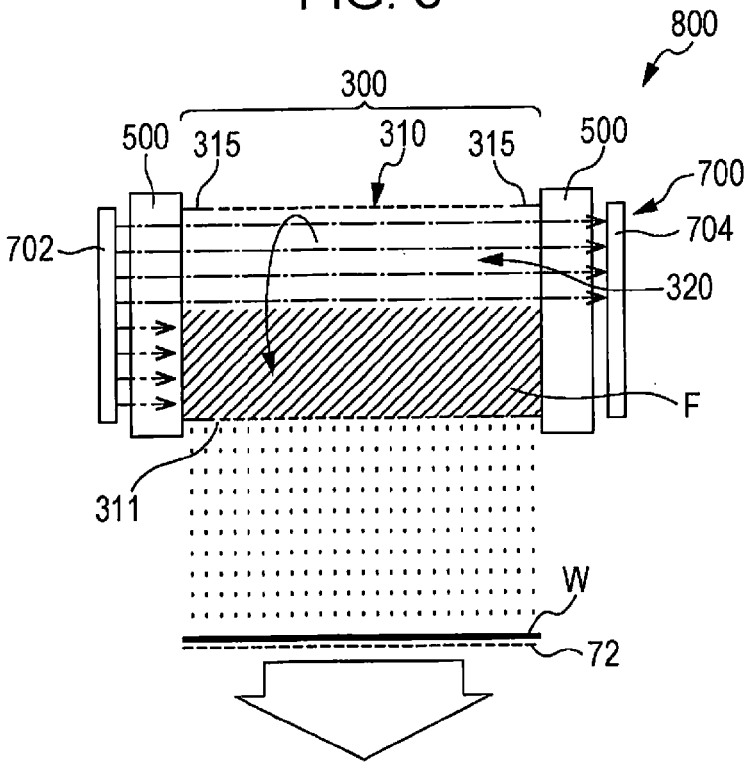
FIG. 3 is a schematic view of the sieve and a detecting unit.

Referring to FIGS. 2 and 3, the dwell area 320 will be described. FIG. 2 is a schematic view of a drum 300 of the sieve 800, and FIG. 3 is a schematic view of the sieve 800 and a detecting unit 700. In FIGS. 2 and 3, the configuration other than the sieve 800 and the detecting unit 700 is not shown.

Although the sieve 800 shown in FIGS. 2 and 3 is the sieve of the above described deposition unit 60, it may be used as the sieve of the screening unit 40.

The sieve 800 of the deposition unit 60 includes a material supply port 560 which is a supply port through which the mixture containing the defibrated material from the defibrating unit 20 is supplied, a plurality of opening ports 311 through which the mixture containing the supplied defibrated material passes, and a dwell area (staying portion) 320 disposed between the material supply port 560 and the opening ports 311 so as to allow the mixture containing the defibrated material to temporarily dwell therein.

The configuration of the sieve 800 will be further described in detail. The sieve 800 includes two side portions 500, 500 which do not rotate, a drum 300 which is a rotating body disposed between the side portions 500, 500, and a fixation member 600 disposed in the drum 300.

The side portions 500, 500 rotatably support the drum 300 by a support section which is not shown in the figure. At least one of the side portions 500 includes an introduction unit 540, and the introduction unit 540 includes the material supply port 560. The material supply port 560 is disposed in a center area which is the same area as the rotation axis R of the drum 300, or alternatively, vertically above the rotation axis R. The defibrated raw material is introduced into the drum 300 via the material supply port 560 of the introduction unit 540.

The drum 300 has a generally cylindrical shape, and includes cylindrical sections 315, 315 disposed on both ends, and an opening port section 310 interposed between the cylindrical sections 315, 315 and having a plurality of opening ports 311 (mesh openings of the sieve). An inner space of the drum 300 is the dwell area 320. The opening port section 310 allows at least the defibrated material (defibrated fiber) to pass therethrough in air. The opening port section 310 and the cylindrical sections 315 rotate together. The opening port section 310 may be a punching metal having holes as a plurality of opening ports 311. The size, forming area and the like of the opening ports 311 may be appropriately defined depending on the size, type and the like of the fiber. A plurality of opening ports 311 have the same size (opening port area) and are arranged with an equal interval. Further, the opening port section 310 is not limited to a punching metal, and may be a wire mesh material.

The fixation member 600 is a plate-shape member which is disposed in the drum 300 and at a position vertically above the rotation axis R. The fixation member 600 is disposed in the longitudinal direction of the drum 300 with the both ends being fixed to the side portions 500, 500. The fixation member 600 has a width larger than that of the opening port section 310. As the drum 300 rotates relative to the side portions 500, 500, it comes into contact with at least defibrated material which moves along with the opening port section 310.

As the drum 300 rotates about the rotation axis R which extends in the horizontal direction, the rotation causes the defibrated material to rotate in the rotation direction of the drum 300. Further, the defibrated material is urged against the inner peripheral surface of the opening port section 310 by a centrifugal force, and the fibers having a size smaller than the size of mesh openings of the opening ports 311 pass through the opening ports 311. The defibrated materials are disentangled in the sieve 800 of the deposition unit 60 so that all the defibrated material introduced into the sieve 800 is essentially allowed to pass through the opening ports 311. Further, when the sieve 800 is used as a sieve of the screening unit 40, the defibrated material is sieved into those allowed to pass through the opening ports 311 and those not allowed to pass through the opening ports 311 depending on the size of the defibrated material.

Further, as the defibrated material affixed on the inner peripheral surface of the opening port section 310 comes into contact (collides) with the fixation member 600, the defibrated material is peeled off from the inner peripheral surface of the opening port section 310 and disentangled. This facilitates the defibrated material to pass through the opening ports 311.

The drum 300 rotates about the rotation axis R by an electric motor which is not shown in the figure. The electric motor is electrically connected to a control unit 140 so as to rotate the drum 300 by a command from the control unit 140 in a direction indicated by the arrow with a predetermined rotation rate.

The dwell area 320 allows the defibrated material to temporarily dwell therein so that the variation amount of the defibrated material that passes through the opening ports 311 becomes smaller than the variation amount of the defibrated material supplied from the material supply port 560. Since the defibrated material is allowed to temporarily dwell in the dwell area 320, variation in the supply amount of defibrated material can be absorbed, thereby reducing variation in the grammage of sheet to be manufactured.

The term "dwell" as used herein refers to a state in which the mixture is retained in the sieve 800 for a period of time longer than the minimum time from when the mixture is supplied into the sieve 800 to when it passes through a plurality of opening ports 311, which are the mesh openings of the sieve.

The dwell area 320 may retain the mixture (defibrated material) of the amount of 30% or more and 80% or less of the volume of the dwell area when the amount of the mixture (defibrated material) supplied from the material supply port 560 is constant per unit time (e.g., per second). Accordingly, variation in the supply amount of mixture can be absorbed by setting the dwell amount to be 30% or more and 80% or less of the dwell area 320, thereby reducing variation in the grammage of sheet to be manufactured.

In variation in the supply amount of mixture, as the supply amount to the material supply port 560 decreases, the mixture sieved through the opening port section 310 decreases, thereby effecting on the grammage of sheet. Accordingly, it is advantageous to increase the dwell amount in the dwell area 320 as possible in order to reduce the variation in the grammage of sheet. Further, it has been revealed that clogging occurs when the dwell amount exceeds 80% of the dwell area 320, thereby reducing the mixture sieved through the opening port section 310. Therefore, variation in the supply amount of mixture can be absorbed by setting the dwell amount to be 30% or more and 80% or less of the dwell area 320, more preferably, 50% or more and 70% or less, thereby reducing variation in the grammage of sheet to be manufactured.

As shown in FIG. 3, the dwell amount in the dwell area 320 can be measured by the detecting unit 700. FIG. 3 is a schematic view of the sieve 800 as shown in the transfer direction of the web W, in which the drum 300 is shown in a vertical cross sectional view so as to show the inside thereof.

The detecting unit 700 is, for example, an optical sensor, and includes a light emitting section 702 and a light receiving section 704 disposed so as to oppose each other with the sieve 800 interposed therebetween. The light emitting section 702 and the light receiving section 704 each extend at least in the length which is the same as the height of the dwell area 320. Light emitted from the light emitting section 702 is incident into the drum 300 through a transparent window, which is not shown in the figure, disposed on the side portion 500. Light is not transmitted through a portion of the dwell area 320 in the drum 300 in which the mixture F is present, which is shown by the hatching in the figure, while light is transmitted through the remaining portion in which the mixture F is not present. The dwell amount of the mixture in the dwell area 320 can be measured by an output from a portion of the light receiving section 704 which receives the transmitted light.

The detecting unit 700 may output the detection result to the control unit 140 shown in FIG. 1, and the control unit 140 may calculate the percentage of the dwell amount to the volume of the dwell area 320 on the basis of the detection result and display it to a display unit or the like. Further, the control unit 140 may control a paper feeding rate (g/sec) from the supplying unit 10 to the crushing unit 12 based on the calculated percentage of the dwell amount so that the dwell amount becomes 30% or more and 80% or less of the dwell area 320.

Further, the detecting unit 700 may not be provided in the sieve 800, and another detection unit such as an optical sensor or a sheet thickness measuring sensor may be provided in the supplying unit 10 shown in FIG. 1 so that the number of sheets or the weight of sheet of the raw material which is supplied per unit time from the supplying unit 10 to the crushing unit 12 is constantly monitored to calculate (estimate) the dwell amount in the dwell area 320 on the basis of the detection result.

When the amount of the mixture (defibrated material) supplied per unit time (e.g., per second) from the material supply port 560 is constant, the dwell area 320 may retain the defibrated material having the mass of 10 times or more, more preferably, 30 times or more of that of the raw material supplied per unit time from the supplying unit 10. Accordingly, when the dwell area 320 allows the defibrated material having the mass of 10 times or more of that of the raw material to dwell therein, variation in the supply amount of raw material due to double feeding (multifeed) or feeding failure of a sheet can be absorbed, thereby reducing variation in the grammage of sheet to be manufactured. Double feeding of the raw material means that two sheets or more are supplied at one time from the supplying unit 10 shown in FIG. 1, although they should have been supplied one by one. Feeding failure of the raw material means that a sheet fails to be supplied from the supplying unit 10 for one time or more, although they should have been supplied one by one.

The inner space of the drum 300 as the dwell area 320 can be achieved, for example, by any of decreasing the size of mesh openings of the opening ports 311, selecting the volume of drum (surface area of the opening port section 310) having an appropriate (small) size relative to the processing ability (g/min), increasing the rotation speed of the drum 300, providing the fixation member 600 having an appropriate size, decreasing a flow rate of the suction mechanism 76 (suctioning unit 48), or combination thereof as appropriate. Those conditions can be appropriately selected depending on the type of raw material, the supply rate of raw material, the productivity of the sheet, the size of apparatus or the like. For example, when used paper of copy sheet in a typical A4 size is provided as the raw material, the mesh openings of the opening ports 311 may be sized in 1 mm, the drum 300 may have a diameter of 220 mm, a width of 210 mm and a rotation speed in the range of 150 rpm to 250 rpm.

Although the above described dwell area 320 is provided only in the deposition unit 60, a first dwell area that allows the defibrated material to temporarily dwell therein may be further provided at a position between the defibrating unit 20 and the deposition unit 60. The first dwell area may have the same configuration as that of the dwell area 320 and may be used for the sieve of the screening unit 40. In this case, the material supply port 560 of the sieve 800 in the deposition unit 60 shown in FIGS. 2 and 3 is provided as a second supply port, the opening ports 311 are provided as second opening ports, and the dwell area 320 is provided as a second dwell area.

The first dwell area of the screening unit 40 will be described in association with the sieve 800 shown in FIGS. 2 and 3. The first dwell area 320 is disposed between the first supply port 560 in which the defibrated material from the defibrating unit 20 is supplied and a plurality of first opening ports 311 which the supplied defibrated material pass through. The first dwell area 320 allows the defibrated material to temporarily dwell therein so that the variation amount of the defibrated material that passes through the first opening ports 311 becomes smaller than the variation amount of the defibrated material supplied from the first supply port 560. Accordingly, since variation in the supply amount is absorbed in two steps by providing two dwell areas, variation in the grammage of sheet to be manufactured can be reduced compared with the case of one dwell area.

1.3. Simulation

Figure 4:
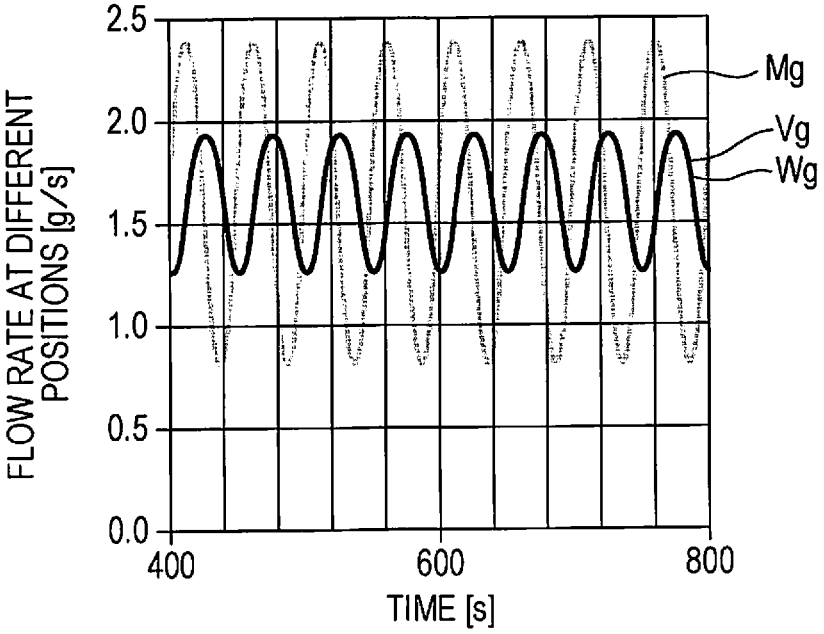
FIG. 4 is a chart simulating a relationship between time and flow rate at different positions in the case where a dwell area is not provided.
Figure 5:
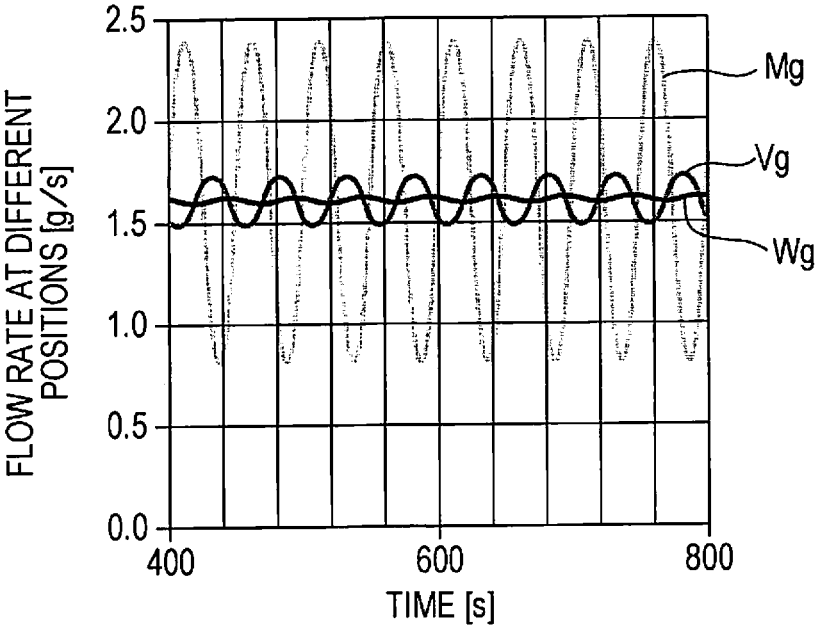
FIG. 5 is a chart simulating a relationship between time and flow rate at different positions in the case where a dwell area is provided.

With reference to FIGS. 1, 4 and 5, pulsation of the flow of defibrated material depending on the presence or absence of the dwell area will be described. FIG. 4 is a chart simulating a relationship between time and flow rate at different positions in the case where a dwell area is not provided, and FIG. 5 is a chart simulating a relationship between time and flow rate at different positions in the case where a dwell area is used.

As shown in FIG. 4, a simulation was performed for a sheet flow rate Mg supplied from the supplying unit 10 (FIG. 1) having an average of approximately 100 (g/min) which varied by ±50% in sine-wave of 50 second cycle. A flow rate Vg of the defibrated material sieved by a first sieve of the screening unit 40 (FIG. 1) and a flow rate Wg of the mixture sieved by a second sieve of the deposition unit 60 (FIG. 1) were the same, and they varied by a significant amount slightly after the variation of the sheet flow rate Mg. The variation of the flow rate Vg led to the variation of the grammage of the web V (FIG. 1), and the variation of the flow rate Wg led to the variation of the grammage of the web W (FIG. 1), which appeared as change in thickness of the sheet S (FIG. 1). This was because the first sieve and the second sieve did not have the dwell area. Further, the flow rate Vg and the flow rate Wg were slightly smaller than the sheet flow rate Mg due to dwelling in the defibrating unit 20 (FIG. 1).

As shown in FIG. 5, a simulation was performed under the same conditions as those of FIG. 4 except for providing a dwell area for each of the first sieve and the second sieve. The flow rate Vg of the defibrated material sieved by the first sieve of the screening unit 40 (FIG. 1) in FIG. 5 had a variation range smaller than that of FIG. 4, and the flow rate Wg of the mixture sieved by the second sieve of the deposition unit 60 (FIG. 1) had a variation range further smaller than the flow rate Vg. The difference between the variation ranges in FIG. 4 and FIG. 5 was due to the fact that the variation of the sheet flow rate Mg was absorbed by the first dwell area of the first sieve and the variation of the sheet flow rate Vg was absorbed by the second dwell area of the second sieve. As a result, providing two dwell areas can reduce the variation of the flow rate Wg (variation in the grammage of web W (FIG. 1)), thereby reducing variation in the grammage (thickness) of the sheet S (FIG. 1).

1.4. Other Simulations

Figure 6:
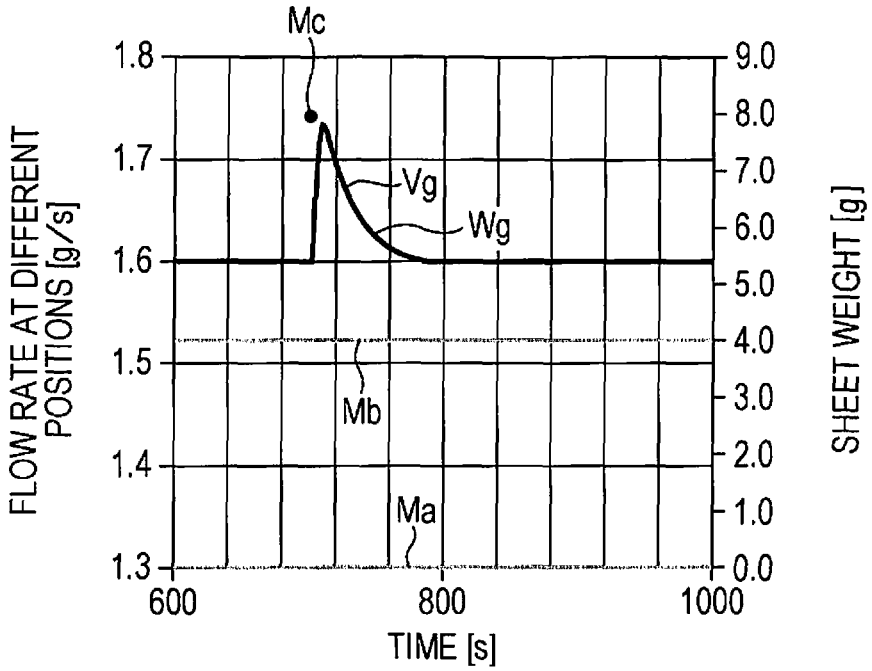
FIG. 6 is a chart simulating a relationship among time, flow rate at different positions and sheet weight in the case where a dwell area is not provided.
Figure 7:
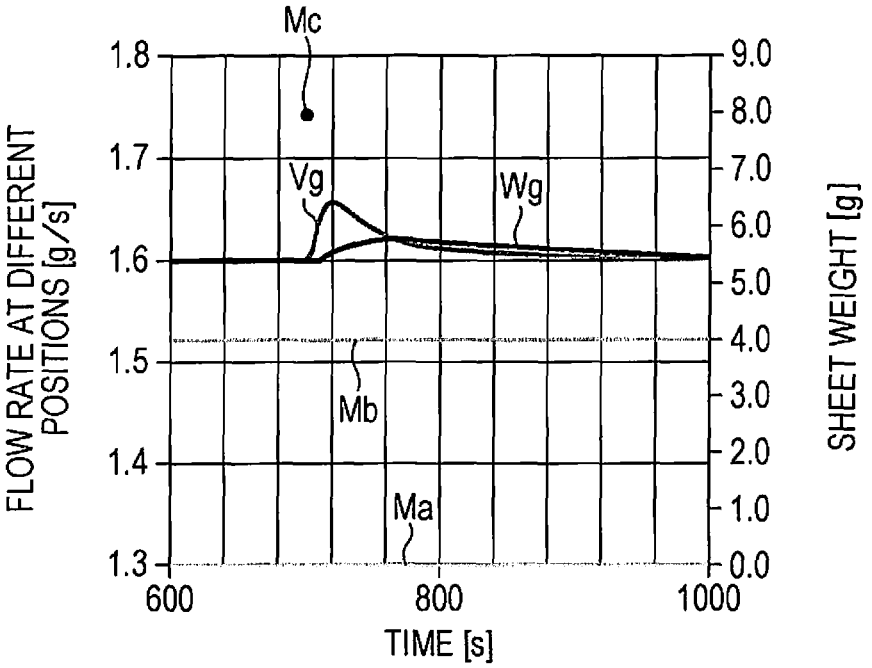
FIG. 7 is a chart simulating a relationship among time, flow rate at different positions and sheet weight in the case where a dwell area is provided.

With reference to FIGS. 1, 6 and 7, other simulations of pulsation of the flow of defibrated material depending on the presence or absence of the dwell area will be described. FIG. 6 is a chart simulating a relationship among time, flow rate at different positions and sheet weight in the case where a dwell area is not provided, and FIG. 7 is a chart simulating a relationship among time, flow rate at different positions and sheet weight in the case where a dwell area is provided.

As shown in FIG. 6, a simulation was performed for double feeding of two sheets which occurred around the time of 720 seconds under the condition that the 4 g sheets were supplied from the supplying unit 10 (FIG. 1) one by one in every 2.5 seconds. The sheet weight Ma, Mb were 0.0 g and 4.0 g, respectively. The sheet weight Mc at the time around 720 seconds was 8.0 g, indicating that double feeding of the sheets occurred. The flow rate Vg of the defibrated material sieved by the first sieve of the screening unit 40 (FIG. 1) and the flow rate Wg of the mixture sieved by the second sieve of the deposition unit 60 (FIG. 1) were the same, and they varied by a significant amount slightly after the sheet weight Mc and were then returned to the original values with the elapse of time. Those large variation of the flow rates Vg, Wg occurred since the first sieve and the second sieve did not have the dwell area.

As shown in FIG. 7, a simulation was performed under the same conditions as those of FIG. 6 except for providing a dwell area for each of the first sieve and the second sieve. The flow rate Vg of the defibrated material sieved by the first sieve of the screening unit 40 (FIG. 1) in FIG. 7 had a variation range smaller than that of FIG. 6, and the flow rate Wg of the mixture sieved by the second sieve of the deposition unit 60 (FIG. 1) had a variation range further smaller than the flow rate Vg. The difference between the variation ranges was due to the fact that the variation from the sheet weight Ma to the sheet weight Mc was absorbed by the first dwell area of the first sieve and the variation of the sheet flow rate Vg was absorbed by the second dwell area of the second sieve. As a result, providing two dwell areas can reduce the variation of the flow rate Wg (variation in the grammage of web W (FIG. 1)) regardless of double feeding of the sheets, thereby reducing variation in the grammage (thickness) of the sheet S (FIG. 1).

2. Sheet Manufacturing Method

A sheet manufacturing method according to the present embodiment includes defibrating a material containing fibers into a defibrated material, and allowing the defibrated material to deposit through a plurality of opening ports to form a sheet, wherein the defibrated material temporarily dwells so that a variation amount of the defibrated material that passes through the opening ports becomes smaller than a variation amount of the supplied defibrated material.

The sheet manufacturing method can be implemented by the sheet manufacturing apparatus 100 which is shown in FIGS. 1 and 2. A specific example will be described with reference to FIGS. 1 and 2, but the invention is not limited thereto.

First, when a user requests a process for manufacturing the sheet S via an operation device, which is not shown in the figure, in the control unit 140, the control unit 140 starts processing for the respective processing units.

(A) The supplying unit 10 supplies sheets of paper as raw material containing fibers to the defibrating unit 20 via the crushing unit 12 one by one with a predetermined interval.

(B) The defibrating unit 20 defibrates the material containing fibers into defibrated material. The defibrated material defibrated by the defibrating unit 20 is transferred to the classifying unit 30 via the pipe 3.

(C) The classifying unit 30 classifies the defibrated material, for example, by density. The defibrated material classified by the classifying unit 30 is transferred to the screening unit 40 via the pipe 4.

(D) The screening unit 40 sieves the defibrated material by the first sieve depending on the length of the fiber. The first sieve includes the drum 300 shown in FIGS. 2 and 3, and the defibrated material temporarily dwells in the dwell area 320, and after that, the defibrated material passes through a plurality of opening ports 311. Since the defibrated material dwells in the dwell area 320, the variation amount of the defibrated material which passes through the opening port 311 becomes smaller than the variation amount of the defibrated material supplied to the first sieve. The first web-forming unit 45 allows the defibrated material which has passed through the opening port 311 to be deposited to form the web V.

(E) The mixing unit 50 mixes an additive agent such as resin with the web V. The mixture obtained by the mixing unit 50 is transferred to the deposition unit 60.

(F) The deposition unit 60 introduces the mixture containing the defibrated material into the second sieve so that the mixture is deposited on the second web-forming unit 70 to form the web W. The second sieve includes the drum 300 shown in FIGS. 2 and 3, and the mixture containing the defibrated material temporarily dwells therein, and after that, the mixture passes through a plurality of opening ports 311. Since the defibrated material dwells in the dwell area 320, the variation amount of the defibrated material which passes through the opening ports 311 becomes smaller than the variation amount of the supplied defibrated material.

(G) The web W is transferred from the second web-forming unit 70 to the sheet-forming unit 80 so as to manufacture the sheet S. The sheet-forming unit 80 applies heat and pressure on the web W, and cuts into a predetermined size to discharge the sheet S into the discharge unit 96.

In this sheet manufacturing method, since the defibrated material is allowed to temporarily dwell, variation in the supply amount of defibrated material can be absorbed, thereby reducing variation in the grammage of sheet to be manufactured.

In the above process (A), sheet feeding may not be limited to intermittent supply as long as the supply amount of sheet per unit time is constant. For example, other sheet feeding method such as continuous feeding that feeds sheets without interval may be used.

Further, the above process (C) may be performed at the same time with the screening process in the first sieve of the screening unit 40 and the first web-forming unit 45. That is, since the defibrated material having relatively small size or low density (which corresponds to the second classified material) passes through the mesh belt 46 and is not deposited on the mesh belt 46, the classifying unit 30 and the above process (C) may be omitted.

The above process (D) may not form the web V, and may transfer the mixture which has passed the opening port 311 to the mixing unit 50 or the deposition unit 60. Further, although the example has been described that the defibrated material dwells in the process (D), the invention is not limited thereto, and the dwell area may be provided only in the process (F).

3. Modification 1

As a modification 1, an operation during the initial operation of the sheet manufacturing apparatus 100 shown in FIGS. 1 and 2 will be described.

In the initial operation of the sheet manufacturing apparatus 100 in which it is first operated after the installation, the defibrated material and the mixture are not present in any of the units. Accordingly, after the operation starts, at least the drum 300 of the deposition unit 60 is not rotated for a certain period of time. The drum 300 starts to rotate when a predetermined amount of mixture is accumulated in the dwell area 320. Since the drum 300 starts to rotate when a predetermined amount of mixture is accumulated in the dwell area 320, the sheet can be manufactured with stable grammage in a relatively short period of time after the operation starts even during the initial operation.

In the case where the dwell area 320 is provided in the screening unit 40, the above operation in the deposition unit 60 can also be applied to the screening unit 40. Specifically, after the operation starts, the drum 300 of the deposition unit 40 is not rotated for a certain period of time. The drum 300 starts to rotate when a predetermined amount of defibrated material is accumulated in the dwell area 320 of the screening unit 40. Accordingly, the web V can be manufactured with stable grammage in a relatively short period of time even during the initial operation. The drum 300 of the deposition unit 60 does not start to rotate for a certain period of time after the drum 300 of the screening unit 40 starts to rotate until a predetermined amount of defibrated material of the web V is accumulated in the dwell area 320 of the deposition unit 60. Since the grammage of the web V is stable, the grammage of the web W and the sheet S also becomes stable.

The above initial operation can be performed by an initial operation mode which is preset in the control unit 140 of the sheet manufacturing apparatus 100. Further, this initial operation mode can be selected for the first operation after the maintenance of the sheet manufacturing apparatus 100, not only as the initial operation of the sheet manufacturing apparatus 100.

4. Modification 2

As a modification 2, an operation during the termination of operation of the sheet manufacturing apparatus 100 shown in FIGS. 1 and 2 will be described.

During the termination of operation of the sheet manufacturing apparatus 100, the drum 300 stops to rotate when a predetermined amount of mixture is accumulated in the dwell area 320 of the drum 300 in the deposition unit 60. The second web-forming unit 70 and the sheet-forming unit 80 continue to operate even after the drum 300 stops to rotate, and stop to operate after the sheet S is discharged. Since the drum 300 stops to rotate when a predetermined amount of mixture is accumulated in the dwell area 320, the sheet can be manufactured with stable grammage immediately after the operation starts since a predetermined amount of mixture is accumulated in the dwell area 320 at the start of the next operation.

In the case where the dwell area 320 is provided in the screening unit 40, the drum 300 of the screening unit 40 is operated in the same manner as the drum 300 of the deposition unit 60. Accordingly, the grammage of the web V at the start of the next operation can be stabilized.

The above termination operation can be performed by a termination operation mode which is preset in the control unit 140 of the sheet manufacturing apparatus 100.

Examples of the sheet described herein include a thin sheet shaped material made of raw material such as pulp and used paper, for example, recording paper used for handwriting or printing, wall paper, wrapping paper, autograph board, drawing paper and kent paper. The non-woven fabric described herein is a material having a larger thickness or a lower strength than that of paper sheet and includes common non-woven fabric, fiber board, tissue paper (tissue paper for cleaning), kitchen paper, cleaner, filter, liquid (waste ink or oil) absorption material, acoustic absorption material, heat insulation material, shock absorbing material, mat and the like. The raw material may be plant fiber such as cellulose, chemical fiber such as PET (polyethylene terephthalate) and polyester or animal fiber such as wool and silk.

The present invention may be partially omitted or the embodiments and modifications of the invention can be combined without departing from the features and effects described in the invention.

The present invention includes a configuration which is substantially the same as those described in the above embodiment (a configuration having the same function, method and result, or a configuration having the same purpose and effect). Further, the present invention includes a configuration having a non-essential part described in the above embodiment being replaced. Further, the present invention includes a configuration that achieves the same operation and effect as described in the above embodiment or a configuration that achieves the same objective. Further, the present invention includes a configuration described in the above embodiment with a known technique added thereto.

The entire disclosure of Japanese Patent Application No. 2015-018189, filed Feb. 2, 2015 is expressly incorporated by reference herein.

What is claimed is:

1. A sheet manufacturing apparatus comprising:

a defibrating unit configured to defibrate a material containing fibers into a defibrated material;

a screening unit configured to screen the defibrated material, the screening unit including a first supply port through which the defibrated material from the defibrating unit is supplied, a plurality of first opening ports through which the supplied defibrated material passes, and a first dwell area disposed between the first supply port and the first opening ports so that the defibrated material temporarily dwells in the first dwell area;

a mixing unit configured to mix an additive agent and a screened defibrated material which has been screened by the screening unit; and a deposition unit configured to deposit a mixture of the additive agent and the screened defibrated material which have been mixed by the mixing unit, the deposition unit including a second supply port through which the mixture is supplied, a plurality of second opening ports through which the supplied mixture passes, and a second dwell area disposed between the second supply port and the second opening ports so that the mixture temporarily dwells in the second dwell area, the second dwell area allowing the mixture to temporarily dwell in the second dwell area so that a variation amount of the mixture that passes through the second opening ports becomes smaller than a variation amount of the mixture supplied through the second supply port, the mixing unit being arranged downstream in a transfer direction of the screened defibrated material relative to the screening unit and upstream in a transfer direction of the mixture relative to the depositing unit.

2. The sheet manufacturing apparatus according to claim 1, wherein the deposition unit includes the second dwell area that allows the mixture of an amount of 30% or more and 80% or less of a volume of the second dwell area to dwell in the second dwell area when an amount of the mixture supplied from the second supply port per unit time is constant.

3. The sheet manufacturing apparatus according to claim 1, further comprising:

a supplying unit configured to supply a material to be defibrated, wherein the second dwell area allows the mixture having a mass of 10 times or more of that of the material supplied from the supplying unit per unit time when the amount of the mixture supplied from the second supply port per unit time is constant.

4. The sheet manufacturing apparatus according to claim 1, wherein the screening unit includes the first dwell area that allows the defibrated material to temporarily dwells in the first dwell area so that a variation amount of the defibrated material that passes through the first opening ports becomes smaller than a variation amount of the defibrated material supplied through the first supply port.

5. A sheet manufacturing method comprising:

defibrating a material containing fibers into a defibrated material;

screening the defibrated material by passing the defibrated material through a plurality of first opening ports;

mixing an additive agent and a screened defibrated material which has been screened; and allowing a mixture of the additive agent and the screened defibrated material to deposit through a plurality of second opening ports to form a sheet, the mixture temporarily dwelling so that a variation amount of the mixture that passes through the second opening ports becomes smaller than a variation amount of the supplied mixture.

* * * * *